US005875741A

United States Patent [19]

Moroi et al.

[11] Patent Number: 5,875,741

[45] Date of Patent: Mar. 2, 1999

[54] VISCOUS FLUID TYPE HEAT GENERATOR WITH HEAT TRANSMISSION ENHANCING MEANS

[75] Inventors: Takahiro Moroi; Takashi Ban; Hidefumi Mori; Takanori Okabe, all of Kariya, Japan

[73] Assignee: Kabushiki Kaisha Toyoda Jidoshokki Seisakusho, Kariya, Japan

[21] Appl. No.: 28,397

[22] Filed: Feb. 24, 1998

[30] Foreign Application Priority Data

Feb. 26, 1997 [JP] Japan ..... 9-042316

[51] Int. Cl.[6] ..... F22B 3/06

[52] U.S. Cl. ..... 122/26; 126/247; 237/12.3 B

[58] Field of Search ..... 122/26, 27; 123/142.5 R; 126/247; 237/12.3 R, 12.3 B

[56] References Cited

U.S. PATENT DOCUMENTS 4,298,111 11/1981 Hayashi ..... 192/58 B 5,727,510 3/1998 Ban et al. ..... 122/26

5,788,151 8/1998 Moroi et al. ..... 122/26

*Primary Examiner*—Teresa Walberg

*Assistant Examiner*—Gregory A. Wilson

*Attorney, Agent, or Firm*—Burgess, Ryan & Wayne

[57] ABSTRACT

A viscous fluid type heat generator having a heat generating chamber in which viscous fluid is confined to frictionally generate heat by an application of shearing action due to rotation of a rotor element rotated by a drive shaft, a heat receiving chamber arranged adjacent to the heat generating chamber to permit heat exchanging liquid to receive heat from the viscous fluid within the heat generating chamber during flowing through the heat receiving chamber, partitioning walls arranged in the heat receiving chamber to define a plurality of radially inner and outer concentric annular liquid passages between a liquid inlet for entrance of the heat exchanging liquid and a liquid outlet for delivery of the heat exchanging liquid, and a liquid guide arranged in a position adjacent to the liquid inlet to divert a part of the heat exchanging liquid entering the heat receiving chamber toward the radially outermost liquid passage in the heat receiving chamber.

15 Claims, 5 Drawing Sheets

VISCOUS FLUID TYPE HEAT GENERATOR WITH HEAT TRANSMISSION ENHANCING MEANS

BACKGROUND OF THE INVENTION

1. Field of the Invention

The present invention relates to a viscous fluid type heat generator of the type which includes a housing assembly defining therein a heat generating chamber in which a viscous fluid is subjected to a shearing action by a rotor element rotating within the heat generating chamber to generate heat. The heat generated by the viscous fluid is transmitted to a heat exchanging liquid, typically water, flowing through a heat receiving chamber defined in the housing assembly and the heat received by the heat exchanging liquid is used as a heat generating source incorporated in, e.g., a heating system or a climate control system of an automobile or another vehicle.

2. Description of the Related Art

U.S. Pat. No. 4,993,377 discloses an example of a vehicle heating system in which a viscous fluid type heat generator, driven by a vehicle engine, generates heat by using a viscous fluid generating heat when it is subjected to a shearing action, is incorporated as a subsidiary heat source. The viscous fluid type heat generator of the vehicle heating system of U.S. Pat. No. '377 is arranged in a secondary water circulating system which is separate from a primary water circulating system circulating an engine-cooling water through an engine-radiator. The primary water circulating system including the engine-radiator functions as a primary heat source for the vehicle heating system.

The engine-cooling water of the secondary water circulating system carries heat generated by the viscous fluid type heat generator to a heat conducting device by which the heat is conducted into a passenger compartment of a vehicle. Thus, the viscous fluid type heat generator functions as an auxiliary heat source for the vehicle heating system, and includes a pair of mutually opposing front and rear housings tightly secured together by appropriate tightening members, such as screw bolts, to define an inner heat generating chamber and a heat receiving chamber arranged so as to surround the heat generating chamber. The heat generating chamber is formed as a fluid-tight chamber and is isolated from the heat receiving chamber by partition walls integral with the front and rear housings, and the heat is exchanged between the viscous fluid in the fluid-tight heat generating chamber and the engine-cooling water in the heat receiving chamber through the partition walls of the housings.

The tightly secured front and rear housings rotatably support a drive shaft therein, via a bearing means, and a rotor element is mounted on an end of the drive shaft so that the rotor element is rotated with the drive shaft within the fluid-tight heat generating chamber. The fluid-tight heat generating chamber is supplied with an appropriate amount of viscous fluid, such as a silicone oil, so that the viscous fluid fills gaps between outer surfaces of the rotor element and partition wall surfaces of the heat generating chamber.

The front housing is provided with a water inlet and a water outlet formed therein, and the above-mentioned heat receiving chamber is fluidly connected to the water inlet to introduce the engine-cooling water therefrom, and is further fluidly connected to the water outlet to discharge the engine-cooling water therethrough. Namely, the heat receiving chamber forms a part of the afore-mentioned secondary water circulating system in which a water pump driven by the vehicle engine is arranged so as to constantly circulate the engine-cooling water through the secondary water circulating system.

When the rotational drive source of the vehicle engine is connected to the drive shaft of the viscous fluid type heat generator via a solenoid clutch, the rotor element fixedly mounted on the drive shaft is rotated therewith within the heat generating chamber to apply a shearing action to the viscous fluid (the silicone oil) held between the outer surfaces of the rotor element and the partition wall surfaces of the heat generating chamber, and accordingly, the viscous fluid frictionally generates heat, and the heat is transmitted to the engine-cooling water circulating through the heat receiving chamber via the partition walls of the heat generating chamber. The engine-cooling water carries the heat to the heat conducting device for the viscous fluid type heat generator, so that the heat conducting device conducts the heat into a passenger compartment of the vehicle.

In the described conventional viscous fluid type heat generator, the rotor element rotating with the drive shaft has a radially outer portion having a circumferential speed larger than that of a radially inner portion thereof extending around the axis of rotation of the rotor element. Thus, the radially outer portion of the rotor element can apply a large shearing speed to the viscous fluid compared with the radially inner portion of the rotor element. Therefore, the viscous fluid held in a region surrounding the radially outer portion of the rotor element has a temperature higher than that of the viscous fluid held in a region adjacent to the radially inner portion of the rotor element. Thus, it is easily understood that transmission of heat from the viscous fluid surrounding the radially outer portion of the rotor element to the engine-cooling water in the heat receiving chamber should effectively be achieved to obtain heat from the viscous fluid, which is sufficient for warming the heated object, namely, the passenger compartment of the vehicle.

Nevertheless, in the conventional viscous fluid type heat generator, the heat receiving chamber is designed so as to permit the engine-cooling water to flow from the water inlet to the water outlet without effectively receiving large amount of heat from the viscous fluid in the heat generating chamber. Namely, the partition walls surrounding the heat generating chamber and fluid-tightly separating the heat generating chamber from the heat receiving chamber are not designed so as to permit effective transmission of heat from the viscous fluid in the heat generating chamber to the engine-cooling water circulating through the heat receiving chamber. Thus, the flow of the engine-cooling water in the heat receiving chamber cannot pass through an outer passage-forming region of the heat receiving chamber where the engine-cooling water is able to receive a large amount of heat transmitting from the viscous fluid which is subjected to the high speed shearing action by the radially outer portion of the rotor element. More specifically, since the outer passage-forming region of the heat receiving chamber is occupied by air so as to prevent the engine-cooling water from reaching that region, the outer passage-forming region of the heat receiving chamber is quite useless from the view point of heat transmission.

SUMMARY OF THE INVENTION

Therefore, an object of the present invention is to provide a viscous fluid type heat generator which includes a heat receiving chamber provided with a water distributing means by which engine-cooling water is permitted to flow through the heat receiving chamber so as to effectively receive heat transmitting from a viscous fluid in the heat generating chamber.

Another object of the present invention is to provide a viscous fluid type heat generator including a heat generating chamber holding a viscous fluid to generate heat and a heat receiving chamber permitting an engine-cooling water to circulate therethrough to effectively receive heat from the viscous fluid without an increase in a flow resistance of the engine-cooling water.

In accordance with the present invention, there is provided a viscous fluid type heat generator which comprises:

a housing assembly defining therein a fluid-tight heat generating chamber in which a viscous fluid is held to frictionally generate heat by application of a shearing action thereto, and a heat receiving chamber having an enclosed liquid passage therein, the heat receiving chamber being arranged adjacent to the fluid-tight heat generating chamber for permitting a heat exchanging fluid to flow therethrough to thereby receive heat from the viscous fluid in the fluid-tight heat generating chamber, the housing assembly having a liquid inlet through which the heat exchanging fluid is introduced into the heat receiving chamber and a liquid outlet through which the heat exchanging liquid is discharged from the heat receiving chamber, the liquid inlet being fluid-tightly separated from the liquid outlet;

a drive shaft supported by the housing assembly to be rotatable about an axis of rotation thereof upon being driven by an external rotation-drive source;

a rotor element mounted to be rotationally driven by the drive shaft for rotation together therewith within the fluid-tight heat generating chamber, the rotor element having primary outer faces extending circularly about the axis of rotation thereof and acting as shearing application faces to apply the shearing action to the viscous fluid during the rotation thereof; and, a liquid guide means arranged adjacent to the liquid inlet for urging a flow of the heat exchanging liquid to be directed toward an entire portion of the enclosed liquid passage at the liquid inlet when the heat exchanging liquid enters the heat receiving chamber through the liquid inlet of the housing assembly.

Preferably, the enclosed liquid passage is defined by a partitioning wall assembly disposed in the heat receiving chamber, the partitioning wall assembly having a predetermined length of path extending between opposite ends of the enclosed liquid passage, one end of the enclosed liquid passage being fluidly connected to the liquid inlet of the housing assembly and the other end being fluidly connected to the liquid outlet of the housing assembly. Further, the predetermined length of path of the enclosed liquid passage through which the heat exchanging liquid flows in the heat receiving chamber is provided with a substantially circular path along which the heat exchanging liquid flows from the liquid inlet to the liquid outlet.

Further preferably, the circular path of the enclosed liquid passage in the heat receiving chamber is arranged to extend about an axis coinciding with the axis of rotation of the rotor element.

Preferably, the liquid guide means is arranged at a predetermined position where a part of the heat exchanging liquid is diverted toward a radially outer region of the enclosed liquid passage having the circular path as soon as the heat exchanging liquid enters the heat receiving chamber.

Further, when the liquid inlet of the housing assembly is formed to include an open mouth having radially inner and outer ends with respect to the axis around which the enclosed liquid passage in the heat receiving chamber extends, the predetermined position of the liquid guide means may be set at an intermediate position between the radially inner and outer ends of the open mouth of the liquid inlet.

When the circular path of the enclosed liquid passage in the heat receiving chamber extends about the axis coinciding with the axis of rotation of the rotor element, the liquid guide means may have a guide surface portion for guiding a flow of the heat exchanging liquid toward a radially outer region of the enclosed liquid passage when the heat exchanging liquid enters the heat receiving chamber.

Preferably, the partitioning wall assembly for defining the enclosed liquid passage in the heat receiving chamber comprises a plurality of circularly extending concentric walls by which a plurality of concentric annular liquid passages are formed between the liquid inlet and the liquid outlet.

The plurality of concentric annular liquid passages are provided to have different radial widths satisfying such a condition that the radial widths of the plurality of concentric annular liquid passages are gradually increased in response to a change in the arrangement of the respective annular liquid passages from the radially innermost annular liquid passage to the radially outermost annular liquid passage.

BRIEF DESCRIPTION OF THE DRAWINGS

The above and other objects, features, and advantages of the present invention will be made more apparent from the ensuing description of the preferred embodiments of the present invention wherein.

DESCRIPTION THE PREFERRED EMBODIMENTS

FIGS. 1 through 4 illustrate a viscous fluid type heat generator according to an embodiment of the present invention, suitable for being used as a subsidiary heat source for a vehicle heating system, specifically an automobile heating system.

Figure 1:
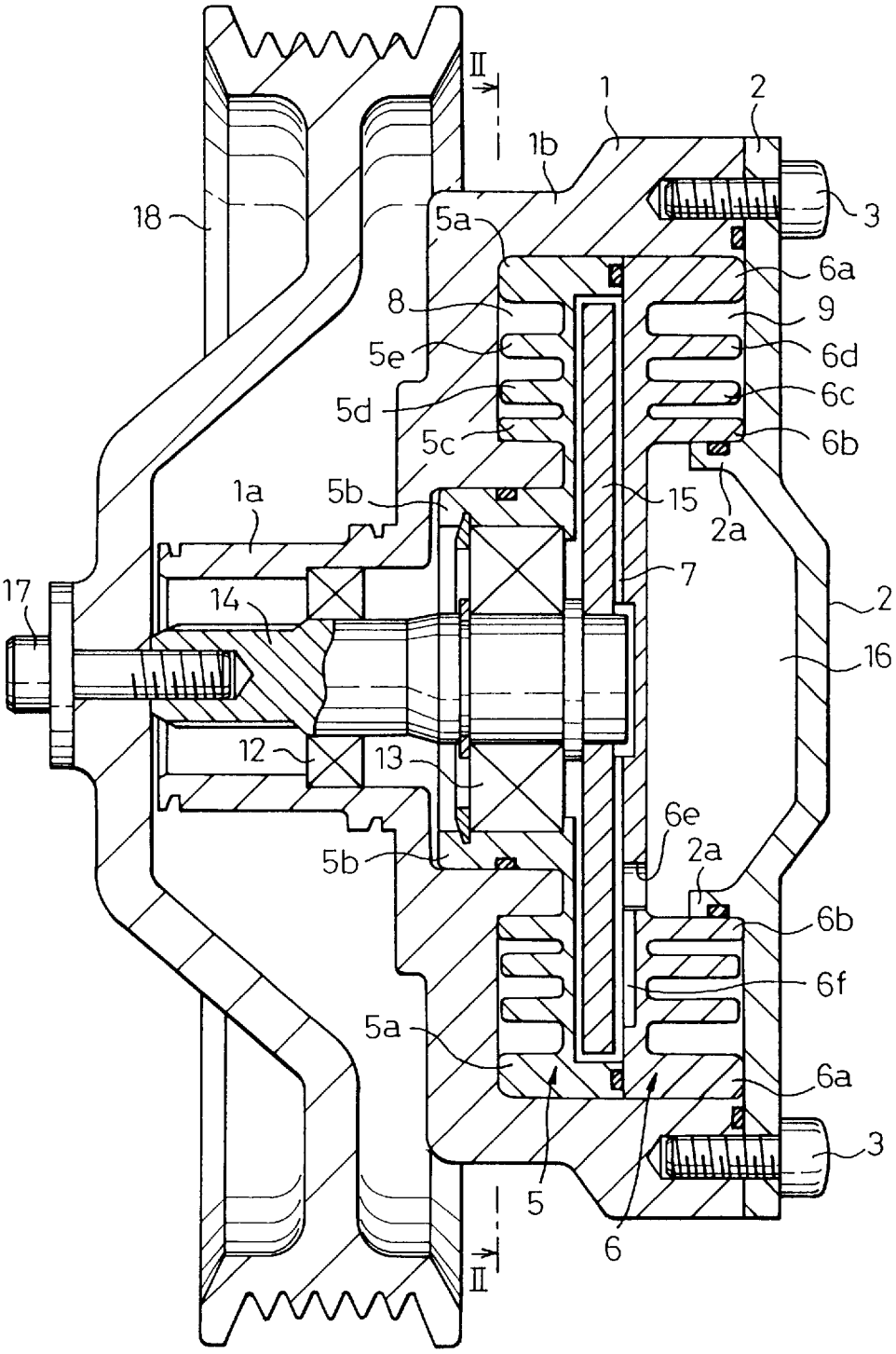
FIG. 1 is a longitudinal cross-sectional view of a viscous fluid type heat generator according to an embodiment of the present invention, taken along the line I—I of FIG. 2.

Referring first to FIG. 1, a viscous fluid type heat generator includes a housing assembly formed as an outer framework of the heat generator, and provided with a front housing 1 and a rear housing 2. The front housing 1 has a cylindrical hollow boss portion 1*a* projecting frontward (leftward in FIG. 1) and a hollow cylindrical frame portion 1*b* having a large diameter and integrally connected to a base portion of the hollow cylindrical boss portion 1*a*. The rear housing 2 is formed as a lid-like member closing a rear open end of the hollow cylindrical frame portion 1*b*. The front housing 1 and the rear housing 2 are tightly connected together by a plurality of connecting screw bolts 3, and define a large chamber therein for receiving a pair of partitioning plate members, i.e., a circular front partitioning plate member 5 and a circular rear partitioning plate member 6. The front partitioning plate member 5 has an outer circular rim portion 5*a* and later-described fin-like cylindrical partitioning walls 5*c*, 5*d*, and 5*e* formed in a front face thereof. Similarly, the rear partitioning plate member 6 has an outer circular rim portion 6*a* and later-described fin-like cylindrical portions 6*b*, 6*c*, and 6*d* formed in a rear end face of the rear partitioning plate member 6. The front and the rear partitioning plate members 5 and 6 are fixedly fitted in the above-mentioned large chamber defined by the front and rear housings 1 and 2, so that the outer circular rim portions 5*a* and 6*a* come in tight contact with one another, and are sandwiched between confronting inner faces of the front and rear housings 5 and 6. The contacting portion of the outer circular rim portions 5*a* and 6*a* of the front and rear partitioning plate members 5 and 6 are sealed by an appropriate sealing element.

Figure 2:
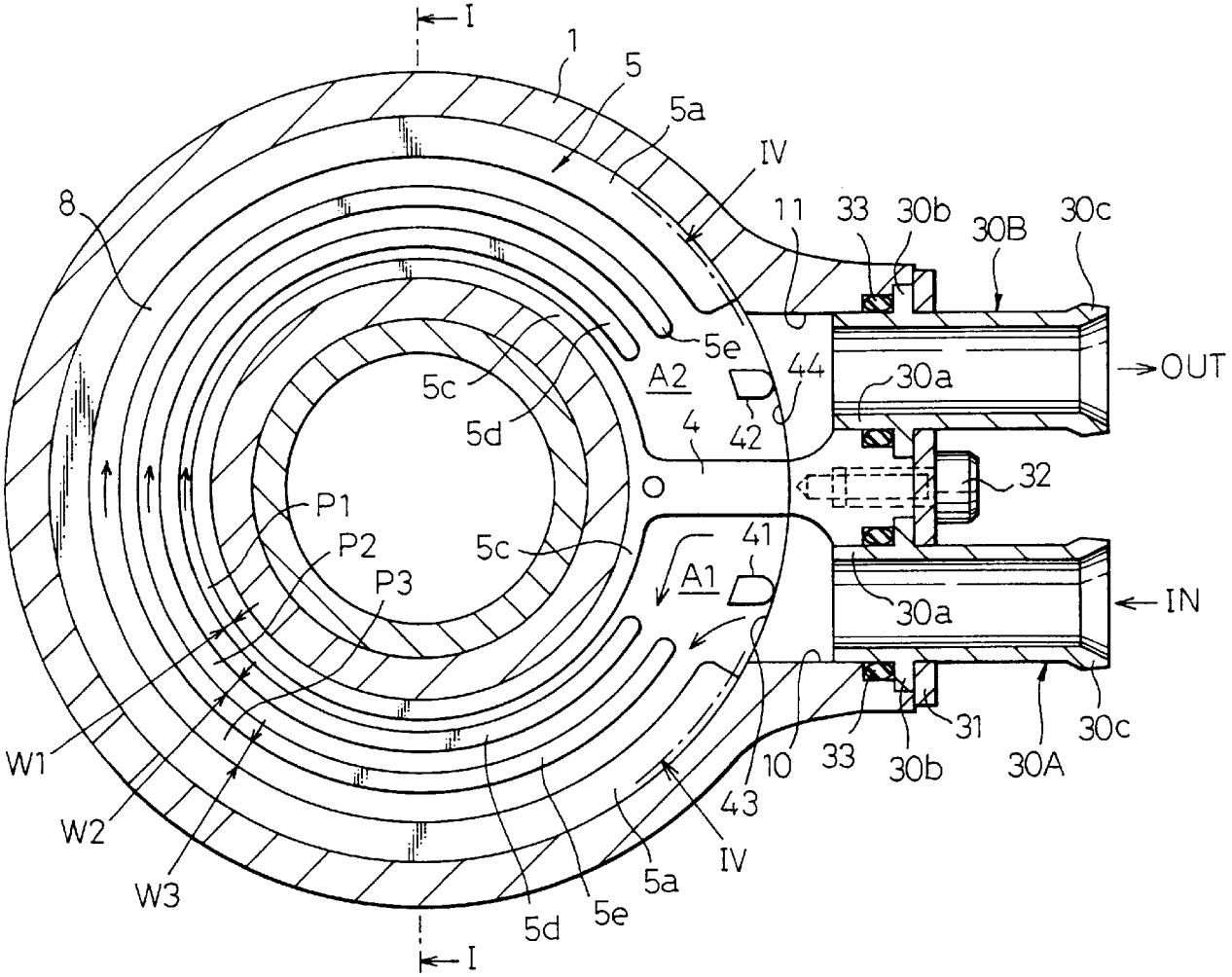
FIG. 2 is a cross-sectional view taken along the line II—II of FIG. 1.

The front partitioning plate member 5 has a generally cylindrical recess formed in a rear end face thereof to define a heat generating chamber 7 between the rear end face of the front partitioning plate member 5 and a front end face of the rear partitioning plate member 6. The front partitioning plate member 5 has, centrally, a cylindrical support portion 5*b* around which the above-mentioned fin-like partitioning walls 5*c* through 5*e* are concentrically arranged. The cylindrical support portion 5*b* of the front partitioning plate member 5 is fluid-tightly fitted in a central bore of the front housing 1 and sealed by an appropriate sealing element. The ends of the fin-like partitioning walls 5*c* through 5*e* of the front partitioning plate member 5 are arranged adjacent to the inner end face of the front housing 1. Thus, a front heat receiving chamber 8 is defined between the inner wall of the front housing 1 and both the outer circular rim portion 5*a* and the fin-like partitioning walls 5*c* through 5*e* of the front partitioning plate member. Namely, the heat receiving chamber 8 is formed by a plurality of concentric annular passages fluidly communicated with one another, and is arranged adjacent to a front portion of the heat generating chamber 7. As shown in FIG. 2, in the plurality of concentric annular passages (the three annular passages P1, P2, and P3 in the present embodiment) of the front heat receiving chamber 8, the innermost passage P1 is defined between the fin-like partitioning walls 5*c* and 5*d*, the intermediate passage P2 is defined between the fin-like partitioning walls 5*d* and 5*e*, and the outermost passage P3 is defined between the fin-like partitioning wall 5*e* and the outer cylindrical rim portion 5*a*. Therefore, the outer cylindrical rim portion 5*a*, and the concentric fin-like partitioning walls 5*c* through 5*e* can function as guide walls for a heat exchanging liquid (the engine-cooling water) which flows through the passages P1 through P3. It should be noted that the annular passages P1, P2, and P3 of the front heat receiving chamber 8 have different widths W1, W2, and W3, respectively, which are gradually made larger (W1<W2<W3) from a radially inner side to a radially outer side of the heat receiving chamber 8.

Referring again to FIG. 1, the rear partitioning plate member 6 centrally has the afore-mentioned cylindrical portion 6*b* formed in the rear end face thereof, and defining a central recessed portion therein. The rear partitioning plate member 6 further has a plurality (two in the present embodiment) of fin-like cylindrical portions 6*c* and 6*d* extending circumferentially around the cylindrical portion 6*b*. Namely, the cylindrical portions 6*b*, 6*c* and 6*d* form a plurality of fin-like circular partitioning walls. The inner wall of the cylindrical portion 6*b* is in tight contact with an outer circumference of a central annular wall 2*a* of the rear housing 2. An appropriate sealing element is provided in the contacting portion of the cylindrical portion 6*b* and the central annular wall 2*a* of the rear housing 2.

A rear heat receiving chamber 9 is defined by the outer circular rim portion 6*a* and the central cylindrical portion 6*b* of the rear partitioning plate member 6 and a radially outer portion of the rear housing 2, so that the rear heat receiving chamber 9 is arranged adjacent to a rear portion of the heat generating chamber 7.

The central recessed portion of the rear partitioning plate member 6 enclosed by the above-mentioned cylindrical portion 6*b* is closed by the central portion of the rear housing 2 and formed as a later-described subsidiary oil chamber 16 in which viscous fluid such as silicone oil is stored.

The rear heat receiving chamber 9 is formed by a plurality (three in the present embodiment) of annular passages similar to the annular passages P1, P2, and P3 of the front heat receiving chamber 8, and are partitioned by the outer circular rim portion 6*a*, and the fin-like circular partitioning walls 6*b*, 6*c* and 6*d*. The outer circular rim portion 6*a* and the fin-like circular partitioning walls 6*b*, 6*c* and 6*d* function as concentric guide walls for the flow of the heat exchanging liquid flowing through the rear heat receiving chamber 9. The radial widths of the respective annular passages of the rear heat receiving chamber 9 are formed to be gradually larger from the radially inner side to the radially outer side of the heat receiving chamber 9 as in the case of the annular passages P1 through P3 of the front heat receiving chamber 8.

It should be understood that the intermediate fin-like annular partitioning walls 5*d*, 5*e*, 6*c*, and 6*d* are formed to intentionally have a small gap left between the respective ends thereof and the inner walls of the front and rear housings 1 and 2. Namely, the ends of the fin-like annular partitioning walls 5*d*, 5*e*, 6*c*, and 6*d* are prevented from coming into contact with the inner walls of the front and rear housings 1 and 2, and therefore, even if the manufacturing of the fin-like annular partitioning walls 5*d*, 5*e*, 6*c*, and 6*d* are inaccurate, the ends of these fin-like partitioning walls 5*d*, 5*e*, 6*c*, and 6*d* can be prevented from coming into strong contact with the inner walls of the front and rear housings 1 and 2. Thus, deformation of the heat generating chamber 7 due to a reaction force produced by the strong contact of the fin-like annular partitioning walls 5*d*, 5*e*, 6*c*, and 6*d* and the inner walls of the front and rear housings 1 and 2 can be prevented. Further, if there is a physical contact between the ends of the fin-like annular partitioning walls 5*d*, 5*e*, 6*c*, and 6*d* and the inner walls of the front and rear housings 1 and 2, a some of the heat generated by the viscous fluid within the heat generating chamber 7 will be directly and undesirably transmitted from the viscous fluid to the front and rear housings 1 and 2 via the fin-like annular partitioning walls 5*d*, 5*e*, 6*c*, and 6*d* before being transmitted to the heat exchanging liquid flowing through the front and rear heat receiving chambers 8 and 9, and accordingly, a loss of heat occurs. Therefore, a contrivance of avoiding the physical contact between the ends of the fin-like annular partitioning walls 5*d,* 5*e,* 6*c,* and 6*d* and the inner walls of the front and rear housings 1 and 2 is made to reduce direct heat transmission from the viscous fluid within the heat generating chamber 7 to the front and rear housings 1 and 2.

As shown in FIG. 2, the front housing 1 is provided with a water inlet port 10 and a water outlet port 11 formed in a part of the side of the housing 1 to be vertically juxtaposed. Namely, the water inlet and outlet ports are disposed to laterally open outward from the part of the side of the housing 1 when the viscous fluid type heat generator is mounted on a vehicle. The front and rear partitioning plate members 5 and 6 are provided with linear walls 4 (only the wall 4 of the front partitioning plate member 5 is shown in FIG. 2), respectively, which extend horizontally and radially. The linear walls 4 are arranged to extend across the annular passages P1, P2, and P3 of the front and rear heat receiving chambers 8 and 9, and are disposed at a vertically intermediate position between entrance and exit ends of each of the annular passages P1, P2, and P3. Thus, there is provided a large space between the entrance ends of the respective annular passages P1 through P3, and the lower inner wall surfaces of the linear walls 4. The above-mentioned large space and the water inlet port 10 define a water inlet region A1 of the front and rear heat receiving chambers 8 and 9. Further, there is provided a similar large space between the exit ends of the respective annular passages P1 through P3, and the upper inner wall surfaces of the linear walls 4. This large space and the water outlet port 11 define a water outlet region A2 of the front and rear heat receiving chambers 8 and 9.

Figure 3:
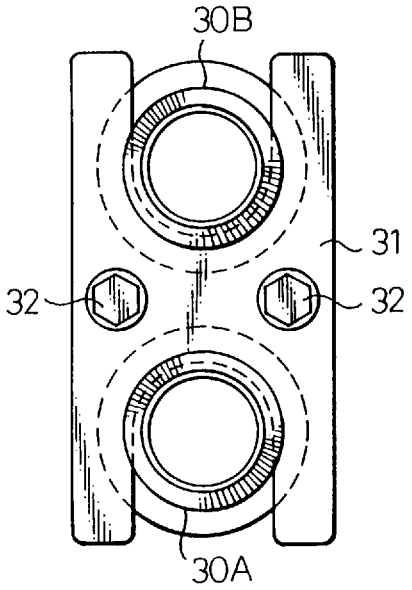
FIG. 3 is a partial front view of an end of the housing assembly of the viscous fluid type heat generator, illustrating pipe joints secured to the end of the housing assembly.

The water inlet and outlet ports 10 and 11 communicate with an external heat exchanging liquid circulating circuit of a vehicle heating system via pipe joints 30A and 30B which are fluid-tightly connected to the ends of the water inlet and outlet ports 10 and 11. Namely, the respective pipe joints 30A and 30B are provided with inner fitting ends 30*a* and seating flanges 30*b,* and outer connecting ends 30*c*. The pipe joints 30A and 30B are fixed to the side wall of the front housing 1 by a pushing plate 31 engaged with the seating flanges 30*b,* and screw bolts 32 threadedly engaging the pushing plate 31 with the side of the front housing 1 as best shown in FIG. 3. O-rings 33 are inserted between the ends of the water inlet and outlet ports 10 and 11 and the fitting ends 30*a* of the pipe joints 30A and 30B.

Figure 4:
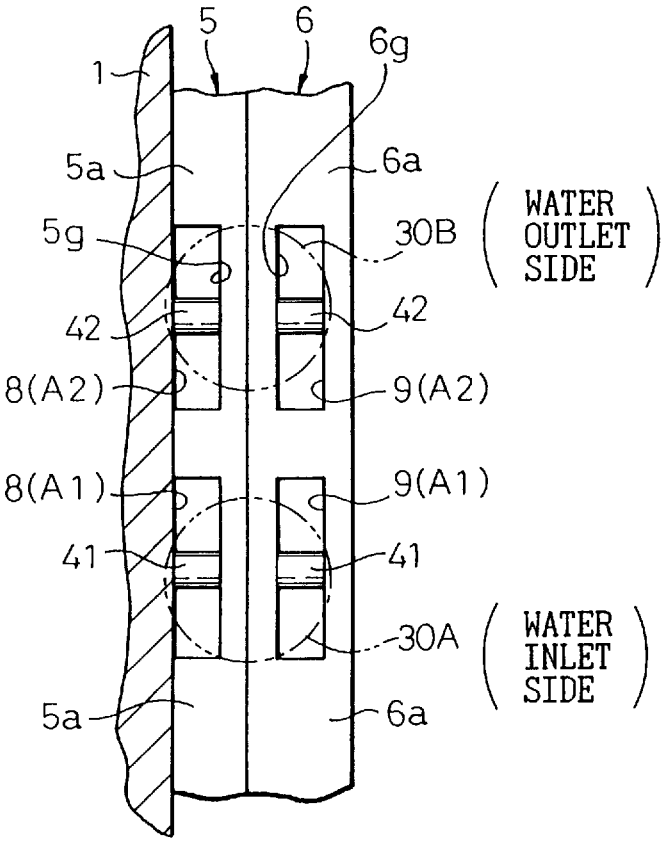
FIG. 4 is a partial view of the housing assembly, in part cross-section taken along the line VI—VI of FIG. 2, illustrating the construction of open mouths of water inlet and outlet provided for the heat generating chamber of the heat generator.

As shown in FIGS. 2 and 4, the front and rear partitioning plate members 5 and 6 are further provided with liquid guides 41 and 42 in the shape of projections from the plate members 5 and 6, which are arranged in the water inlet region A1 and water outlet region A2 of the front and rear heat receiving chambers 8 and 9, respectively.

The description of the liquid guides 41 and 42 will be provided hereinbelow with respect to those provided by the front partitioning plate member 5 with reference to FIGS. 2 and 4.

The liquid guide 42 arranged in the water outlet region A2 is provided so as to project from a flat inner face 5*g* in the same direction as the outer cylindrical rim portion 5*a,* and has substantially the same length as the rim portion 5*a*. The end of the outer cylindrical rim portion 5*a* in the water outlet region A2 and the upper surface of the linear wall 4 define therebetween a delivery aperture 44 in the shape of an open mouth fluidly connected to the water outlet port 11. The liquid guide 42 is disposed at a substantially intermediate position between the end of the cylindrical rim portion 5*a* and the upper surface of the linear wall 4. That is, the liquid guide 42 is positioned at a central position of the delivery aperture 44 so as to be capable of working as a rib element physically reinforcing walls of the water outlet region A2.

The liquid guide 41 arranged in the water inlet region A1 is provided so as to project from a flat inner face 5*g* of the front partitioning plate member 5 in the same direction as the outer cylindrical rim portion 5*a,* and has substantially the same length as the rim portion 5*a*. The end of the outer cylindrical rim portion 5*a* in the water inlet region A1 and the lower surface of the linear wall 4 define therebetween an entrance aperture 43 in the shape of an open mouth. The liquid guide 41 is disposed at a substantially intermediate position between the end of the cylindrical rim portion 5*a* and lower surface of the linear wall 4. That is, the liquid guide 41 is positioned at a substantially central position of the entrance aperture 43 so as to capable of working as a rib element physically reinforcing walls of the water inlet region A1. The liquid guide 41 in the water inlet region A1 is further capable of working as a liquid distribution guide for urging the flow of heat exchanging liquid (the engine cooling water) entering into the water inlet region A1 from the water inlet port 10 to be distributed toward all of the annular passages P1 through P3 of the front heat receiving chamber 8. Particularly, the liquid guide 41 intentionally diverts a certain part of the flow of the heat exchanging liquid toward the radially outermost annular passage P3. To this end, the liquid guide 41 is formed to have specifically round corners facing the entrance aperture 43 and the water inlet port 10. Namely, the round corner of the liquid guide 41 smoothly diverts the flow of the heat exchanging liquid as soon as the liquid enters the water inlet region A1 through the water inlet port 10 and the entrance aperture 43.

Although the above description is provided with reference to the liquid guides 41 and 42 provided by the front partitioning plate member 5, it should be noted that the liquid guides 41 and 42 provided by the rear partitioning plate member 6 are similarly formed as projections protruding from an inner flat face 6*g* of the plate member 6 in the same direction as the outer circular rim portion 6*a,* and exhibit the same function as the liquid guides 41 and 42 provided by the front partitioning plate member 5.

As shown in FIG. 1, a drive shaft 14 is rotatably mounted in the front housing 1 and the front partitioning plate member 5 via an anti-friction bearing 12 and a sealed bearing 13. The latter sealed bearing 13 is interposed between the inner face of the cylindrical support portion 5*b* of the front partitioning plate member 5 and the outer face of the drive shaft 14 so as to isolate a front region of the heat generating chamber 7. An innermost end (a rear end) of the drive shaft supports thereon a rotor element 15 press-fitted therein to be rotated together with the drive shaft 14 within the heat generating chamber 7.

The subsidiary oil chamber 16 for storing the viscous fluid (the silicone oil) is provided by the cylindrical portion 6*b* of the rear partitioning plate member 6 and the central portion of the rear housing 2. The subsidiary oil chamber 16 communicates with the heat generating chamber 7 via a plurality of through-holes 6*e* (only one through-hole 6*e* is shown in FIG. 1) formed in rear partitioning plate member 6, and via a radial groove 6*f* formed in the front face of the rear partitioning plate member 6. The heat generating chamber 7 and the subsidiary oil chamber 16 are fluidly sealed to be isolated from the remaining portion inside the housing assembly of the viscous fluid type heat generator. Thus, the heat generating chamber 7 and the subsidiary oil chamber 16 are supplied with a predetermined amount of viscous fluid, i.e., the silicone oil suitable for generating heat required for auxiliarily heating the objective heating area in a vehicle such as a passenger compartment of an automobile. Generally, the amount of viscous fluid supplied into the heat generating chamber 7 and the subsidiary oil chamber 16 is determined to be 50 through 80% of the total free volume provided by the heat generating chamber 7 and the subsidiary oil chamber 16 at an ordinary temperature. Namely, when the above-mentioned predetermined amount of silicone oil is filled in the heat generating chamber 7 and the subsidiary oil chamber 16, the silicone oil is withdrawn from the subsidiary oil chamber 16 into the heat generating chamber 7 via the through-holes 6*e* due to the extension viscosity of the silicone oil during the rotation of the rotor element 15, and constantly fills small gaps between the inner walls of the heat generating chamber 7 and the outer faces of the rotor element 15.

A pulley element 18 is fixedly attached to a frontmost end of the drive shaft 14 by a screw bolt 17. The pulley element 18 is connected to a vehicle engine via a conventional V-belt to transmit the engine drive power to the drive shaft 14 of the viscous fluid type heat generator. Therefore, the drive shaft 14 together with the rotor element 15 are rotationally driven by the external vehicle engine. Accordingly, the silicone oil in the gaps between the inner faces of the heat generating chamber 7 and the outer faces of the rotor element 15 is subjected to a shearing action by the rotating rotor element 15 to generate heat. The heat generated by the silicone oil within the heat generating chamber 7 is transmitted to the heat exchanging liquid (the engine-cooling water) flowing through the front and rear heat receiving chambers 8 and 9 via the front and rear partitioning plate members 5 and 6. The heat exchanging liquid circulates through the liquid circulating circuit of the vehicle heating system to carry the heat to warm the objective heated area.

At this stage, in the embodiment of the viscous fluid type heat generator of FIGS. 1 through 4, the heat generator is mounted in an engine compartment of a vehicle, so that the front and rear partitioning plate members 5 and 6 are disposed to be substantially vertical to the surface of the ground. Thus, the water inlet port 10 is located below the water outlet port 11, and both ports 10 and 11 are disposed to be substantially horizontal. The pipe joints 30A and 30B of the front housing 1 are connected to the heat exchanging circuit of the vehicle heating system having a water pump to pump the engine-cooling water. The heat exchanging liquid (the engine-cooling water) is introduced into the viscous fluid type heat generator via the lower pipe joint 30A, and delivered from the upper pipe joint 30B. When the heat exchanging liquid is introduced through the lower pipe joint 30A into the water inlet region A1 including the water inlet port 10, the liquid flows toward the entrance ends of the respective annular passages P1 through P3. The liquid guides 41 in the front and rear heat receiving chambers 8 and 9 divide the flow of the heat exchanging liquid linearly flowing from the pipe joint 30A and the water inlet port 10 into vertically upper and lower flows as soon as the flow of the heat exchanging liquid flows past the entrance aperture 43. Thus, a positive flow component of the heat exchanging liquid directing toward the outermost annular passages P3 of both front and rear heat receiving chambers 8 and 9 is generated. Namely, the outermost annular passages P3 having the largest radial width can be surely supplied with a sufficient amount of heat exchanging liquid.

The flow of the heat exchanging liquid within each of the annular passages P1, P2, and P3 gradually flows from the entrance end to the delivery end thereof while passing through the vertically lowest position and the vertically highest position within each passage. The flow of the heat exchanging liquid within each of the passages P1 through P3 is subsequently delivered from the delivery apertures 44 and the water outlet ports 11 of the front and rear heat receiving chambers 8 and 9 toward the vehicle heating system via the upper pipe joint 30B.

It should be noted that, in the described embodiment of FIGS. 1 through 4, since the front and rear heat receiving chambers 8 and 9 are provided with concentric circular guide walls formed therein and consisting of the aforementioned outer cylindrical rim portions 5*a,* 6*a,* and the concentric fin-like partitioning walls 5*c* through 5*e,* and 6*b* through 6*d,* a plurality of liquid passages P1 through P3 can be provided in both of the front and rear heat receiving chambers 8 and 9. Each of the plurality of passages P1 through P3 can have an individual constant cross-sectional area along the flow line of the liquid from the entrance end to the delivery end thereof. For example, when it is taken into consideration that the annular passage P2 having the radial width W2 and formed between the fin-like partitioning walls 5*d* and 5*e* having an equal length "h" from the bottom to the end thereof, the cross-sectional area of the annular passage P2 for the heat exchanging liquid is determined to be constantly (h×W2) at each position along the flow line of the heat exchanging liquid within the annular passage P2. In addition, the heat exchanging liquid is introduced from the vertically lower water inlet port 10 into each of the annular passages P1 through P3, and delivered therefrom toward the external heat exchanging liquid circuit via the vertically higher water outlet ports 11. Therefore, in the respective annular passages P1 through P3 of the front and rear heat receiving chambers 8 and 9, the heat exchanging liquid is forced to flow in an identical direction while sequentially passing the vertically lowest position and the vertically highest position within each of the annular passages P1 through P3. Thus, the heat exchanging liquid is urged to flow in the annular passages P1 through P3 having individually constant cross-sectional area and in the predetermined identical flow direction, and therefore, the respective annular passages P1 through P3 of the front and rear heat receiving chambers 8 and 9 from the respective entrance ends to the delivery ends can be constantly filled with the heat exchanging liquid during the operation of the vehicle engine. Therefore, an effective heat exchange between the viscous fluid (the silicone oil) and the heat exchanging liquid (the engine-cooling water) can be constantly achieved during the operation of the viscous fluid type heat generator.

The various advantages provided by the viscous fluid type heat generator according to the embodiment of FIGS. 1 through 4 will be set forth below.

(a) The liquid guides 41 in the shape of projections arranged in the water inlet region A1 of the front and rear heat receiving chambers 8 and 9 can distribute the main part of the flow of the heat exchanging liquid supplied from the outside of the heat generator to the radially outermost annular passages P3. Thus, the passages P3 can be constantly supplied with a sufficient amount of the heat exchanging liquid. Therefore, the speed of the heat exchanging liquid flowing in the passages P3 can be made relatively larger than that of the liquid flowing in the radially inner passages P1 and P2. Thus, although the length of flow of the liquid within the passages P3 is larger than that within the passages P1 and P2, the amounts of the flow of the heat exchanging liquid in the respective annular passages P1 through P3 with respective to a unit time interval can be balanced with one another. Accordingly, the heat transmission efficiencies of the respective heat exchanging liquids in the respective annular passages P1 through P3 can also be balanced. Particularly, since the amount of flow of the heat exchanging liquid in the outermost annular passages P3 is made larger than that in the radially inner passages P1 and P2, the liquid flowing in the passages P3 can effectively receive heat from the viscous fluid which is held around the radially peripheral portion of the rotor element 15 and actively generates heat due to a strong shearing action provided by the radially peripheral portion of the rotor element 15.

According to a comparative experiment conducted by a method of simulation using an appropriate conventional electronic computer, with respect to a viscous fluid type heat generator having the liquid guides 41 in the water inlet region A1, as shown in FIG. 4, and a different heat generator having no liquid guides 41 in a water inlet region, it was confirmed that the provision of the liquid guides 41 is very effective for suitably guiding the heat exchanging liquid toward the radially outermost annular passages P3 in the front and rear heat receiving chambers 8 and 9. Namely, when the liquid guides are not arranged in the water inlet region A1, a distribution of the heat exchanging liquid to the outermost passages P3 is insufficient compared with the remaining radially inner passages P1 and P2.

(b) When the liquid guides 41 are formed to be rounded at the corners thereof facing the water inlet port 10, the heat exchanging liquid entering the water inlet region A1 can be smoothly divided into separate flows of the liquid flowing toward the annular passages P1 through P3. Thus, it should be understood that the provision of the liquid guides 41 in the water inlet region A1 does not cause an unfavorable increase in flow resistance against the heat exchanging liquid passing by the liquid guides 41.

(c) The arrangement of the plurality of specified annular passages P1 through P3 in the front and rear heat receiving chambers 8 and 9, and the determination of flowing direction of the heat exchanging liquid by the predetermined arrangement of the vertically juxtaposed lower water inlet port 10 and upper water outlet port 11 for the heat exchanging liquid permit the entire region in the front and rear heat receiving chambers 8 and 9 to be constantly filled up with the heat exchanging liquid. Thus, heat transmission from the viscous fluid in the heat generating chamber 7 to the heat exchanging liquid flowing through the annular passages P1 through P3 via the fin-like partitioning walls 5*c* through 5*e*, 6*b* through 6*d*, and other walls of the front and rear partitioning plate members 5 and 6 is very good and, accordingly, a high heat exchanging efficiency can be achieved to result in an increase in a heat generating efficiency of the viscous fluid type heat generator. This fact also contributes to prevention of thermal deterioration of the viscous fluid caused by excessive heating of the viscous fluid.

(d) Since the radial widths of the concentric annular liquid passages P1 through P3 are made gradually larger from the innermost passages P1 to the outermost passages P3, the speed of respective flows of the heat exchanging liquid flowing through the passages P1 through P3 can be adjusted in relation to a difference in the length of path among the radially innermost, intermediate, and outermost passages P1 through P3. Therefore, all portions of the walls of the front and rear partitioning plate members 5 and 6 defining the front and rear heat receiving chambers 8 and 9 can contribute to uniform heat exchange between the viscous fluid within the heat generating chamber 7 and the heat exchanging liquid circulating through the front and rear heat receiving chambers 8 and 9.

Figure 5:
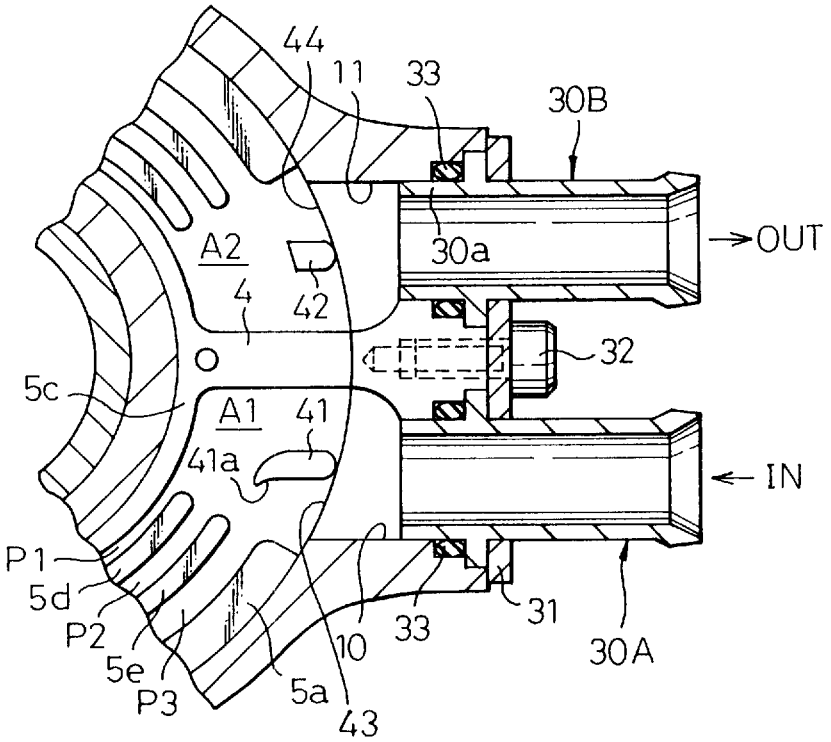
FIG. 5 is a partial cross-sectional view of the viscous fluid type heat generator, illustrating the construction of the heat receiving chamber and open mouths of the water inlet and outlet, according to another embodiment of the present invention.

FIG. 5 illustrates another embodiment of the present invention in which the front and rear heat receiving chambers 8 and 9 are provided with modified liquid guides 41 arranged in the water inlet region A1. Namely, the modified liquid guides 41 formed in the front and rear partitioning plate members 5 and 6 are elongated toward the fin-like partitioning walls 5*c* and 6*b* compared with the aforedescribed liquid guides 41 of the embodiment of FIGS. 1 through 4. Further, the modified liquid guides 41 of the front and rear partitioning plate members 5 and 6 are provided with curved guide faces 41*a* extending toward the fin-like partitioning walls 5*e* and 6*d*. The modified liquid guides 41 with the curved guide faces 41*a* can urge the heat exchanging liquid entering the water inlet region A1 via the entrance aperture 43 to surely flow toward the radially outermost annular passages P3 under the guidance of the curved guide faces 41*a*.

Figure 6:
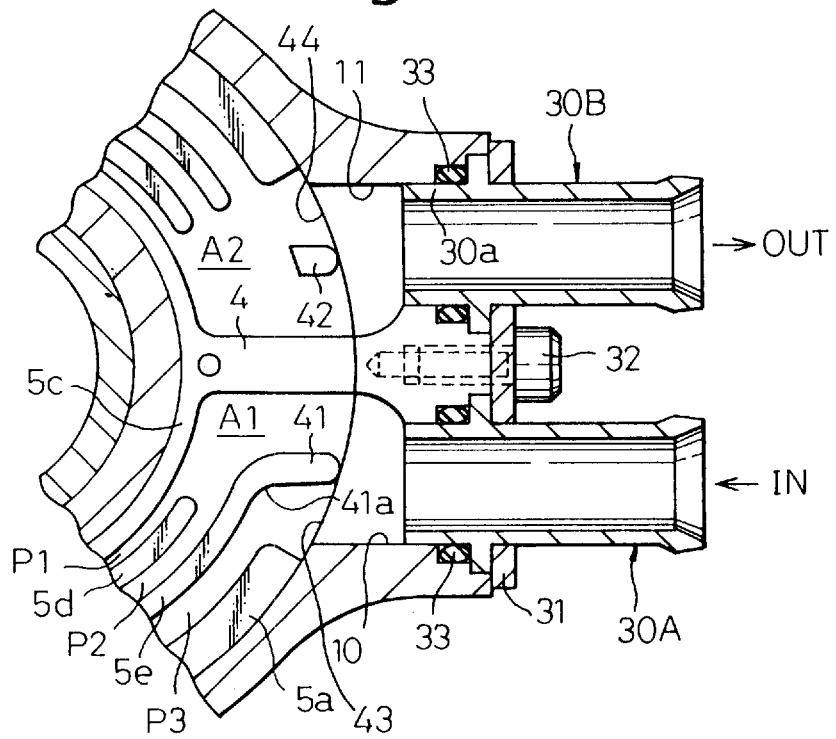
FIG. 6 is a partial cross-sectional view similar to FIG. 5, illustrating the construction of the heat receiving chamber and open mouths of the water inlet and outlet, according to a further embodiment of the present invention; and, FIG. 7 is a partial cross-sectional view similar to FIG. 5, illustrating the construction of the heat receiving chamber and open mouths of the water inlet and outlet, according to a further embodiment of the present invention.

FIG. 6 illustrates a further embodiment of the present invention in which the liquid guides 41 are further modified from those of the embodiments of FIGS. 1 through 4 and FIG. 5. Namely, the modified liquid guide 41 of the present embodiment is formed to be connected to the entrance end of the fin-like partitioning walls 5*e* and 6*d* which define the radially outermost annular passages P3. Namely, the modified liquid guide 41 is arranged to be integral with the partitioning walls 5*e* and 6*d*, and accordingly, a continuous guide face 41*a* is provided for directly guiding a part of flow of the heat exchanging liquid entering the water inlet port 10 toward the radially outermost annular passages P3.

Figure 7:
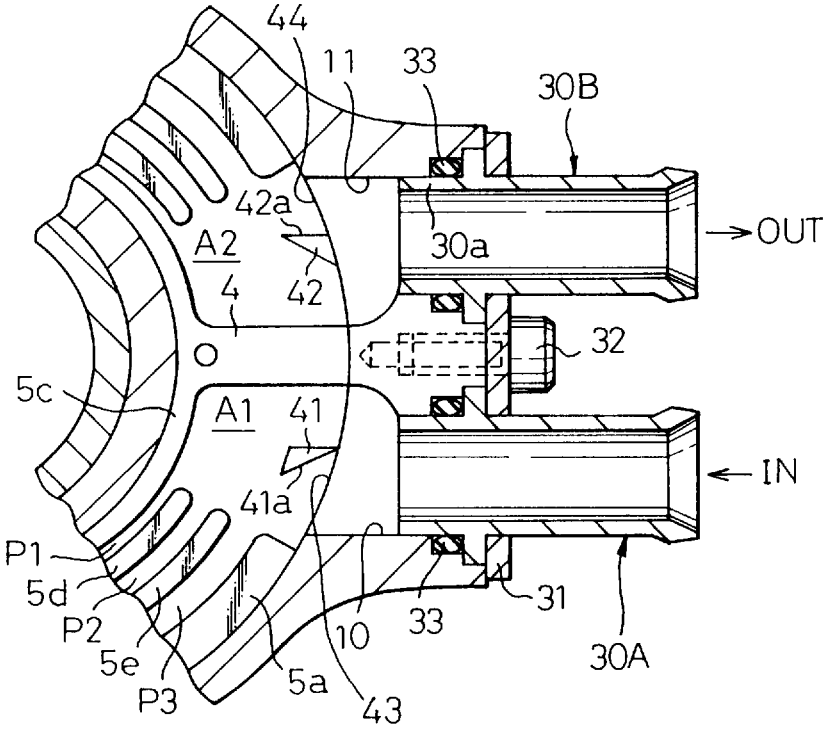

FIG. 7 illustrates a further embodiment of the present invention in which the liquid guides 41 arranged in the water inlet region A1 of the front and rear heat receiving chambers 8 and 9 are formed as projections having a triangular cross-section. Each triangular liquid guide 41 is disposed to have an acute angle corner thereof directly facing the entrance aperture 43 and the water inlet port 10 so as to provide a guide face 41*a* inclined from a horizontal line toward each of the fin-like partitioning walls 5*e* and 6*d*. Thus, the guide face 41*a* of the triangular liquid guide 41 can guide a flow of the heat exchanging liquid entering the water inlet region A1 via the entrance aperture 43 and the water inlet port 10 toward the radially outermost passages P3 without an increase in a flow resistance against the entering flow of heat exchanging liquid entering the water inlet region A1.

Further, the liquid guides 42 arranged in the water outlet region A2 of the front and rear heat receiving chambers 8 and 9 are formed as projections of the front and rear partitioning plate members 5 and 6, and have a triangular cross-section as clearly shown in FIG. 7. At this stage, each of the triangular liquid guides 42 is disposed to have an acute angle corner thereof directly facing the radially innermost partitioning wall 5*c* or 6*b*, and a substantially horizontal guide face 42*a*. The liquid guides 42 can smoothly guide the flow of the heat exchanging liquid delivering from the front and rear heat receiving chambers 8 and 9, specifically from the passages P3, toward the water outlet port 11 via the delivering aperture 44 without an increase in a flow resistance against the delivering flow of the heat exchanging liquid.

It should be understood that the liquid guides 42 formed as projections from the front and rear partitioning plate members 5 and 6, as shown in FIGS. 2, 4, 5, 6 and 7 are arranged to function as physically reinforcing ribs rather than guides for urging the flow of the heat exchanging liquid toward a specified direction. Nevertheless, since the described viscous fluid type heat generator is not required to have a particularly large physical strength when it is used with the vehicle heating system, the liquid guides 42 arranged in the water outlet region A2 may be omitted. Thus, the liquid guides 42 are not indispensable elements for constituting the present invention.

From the foregoing description of the preferred embodiments of the present invention, it will be understood that since the viscous fluid type heat generator according to the present invention has an improved heat receiving chamber in which annularly extending liquid passages are provided so that the flow of the heat exchanging liquid is distributed to all portions within the heat receiving chamber, the heat transmission from the viscous fluid generating heat within the heat generating chamber to the heat exchanging liquid flowing through the heat receiving chamber can be conducted with a high heat transmission efficiency without causing an increase in the flow resistance.

It should be understood that although a typical viscous fluid used for the viscous fluid type heat generator may be the described silicone oil, other flowing substances having a high viscosity may be used for frictionally generating heat within the confined heat generating chamber.

Moreover, it should be understood that many changes and modifications will occur to persons skilled in the art without departing from the scope and spirit of the present invention as claimed in the accompanying claims.

We claim:

1. A viscous fluid type heat generator comprising:

a housing assembly defining therein a fluid-tight heat generating chamber in which a viscous fluid is held to frictionally generate heat by the application of a shearing action thereto, and a heat receiving chamber having an enclosed liquid passage therein, said heat receiving chamber being arranged adjacent to said fluid-tight heat generating chamber for permitting a heat exchanging fluid to flow therethrough to thereby receive heat from the viscous fluid in said fluid-tight heat generating chamber, said housing assembly having a liquid inlet through which the heat exchanging fluid is introduced into said heat receiving chamber and a liquid outlet through which the heat exchanging liquid is discharged from said heat receiving chamber, said liquid inlet being fluid-tightly separated from said liquid outlet;

a drive shaft supported by said housing assembly to be rotatable about an axis of rotation thereof upon being driven by an external rotation-drive source;

a rotor element mounted to be rotationally driven by said drive shaft for rotation within said fluid-tight heat generating chamber, said rotor element having primary outer faces extending circularly about the axis of rotation thereof and acting as shearing application faces to apply a shearing action to the viscous fluid during the rotation thereof; and, a liquid guide means arranged adjacent to said liquid inlet for urging a flow of the heat exchanging liquid to be directed toward the entirity of said enclosed liquid passage at said liquid inlet when the heat exchanging liquid enters said heat receiving chamber through said liquid inlet of said housing assembly.

2. A viscous fluid type heat generator according to claim 1, wherein said enclosed liquid passage is defined by a partitioning assembly disposed in said heat receiving chamber, said partitioning wall assembly having a predetermined path extending between opposite ends of said enclosed liquid passage, one end of said enclosed liquid passage being fluidly connected to said liquid inlet of said housing assembly and the other end being fluidly connected to said liquid outlet of said housing assembly, and wherein the predetermined path of said enclosed liquid passage through which the heat exchanging liquid flows in said heat receiving chamber is a substantially circular path along which the heat exchanging liquid flows from said water inlet to said water outlet.

3. A viscous fluid type heat generator according to claim 2, wherein said circular path of said enclosed liquid passage in said heat receiving chamber is arranged to extend about an axis coinciding with the axis of rotation of said rotor element.

4. A viscous fluid type heat generator according to claim 2, wherein said liquid guide means is arranged at a predetermined position where a part of the heat exchanging liquid is diverted toward a radially outer region of said enclosed liquid passage having said circular path as soon as the heat exchanging liquid enters said heat receiving chamber.

5. A viscous fluid type heat generator according to claim 4, wherein said liquid guide means comprises a projection projecting from a part of said partitioning wall assembly to said predetermined position, said projection being provided with a rounded portion facing said liquid inlet, said rounded portion of said projection separating the heat exchanging liquid to guide part of the heat exchanging liquid toward said radially outer region of said enclosed liquid passage.

6. A viscous fluid type heat generator according to claim 5, wherein said projection of said liquid guide means is further provided with a guide face cooperating with said rounded portion of said projection to guide said part of the heat exchanging liquid toward said radially outer region of said enclosed liquid passage.

7. A viscous fluid type heat generator according to claim 4, wherein said liquid guide means comprises a projection projecting from a part of said partitioning wall assembly to said predetermined position, said projection being formed to have a triangular cross-section provided with an acute angle edge facing said water inlet, said acute edge of said projection separating the heat exchanging liquid to form said part of the heat exchanging liquid diverted toward said radially outer region of said enclosed liquid passage.

8. A viscous fluid type heat generator according to claim 2, wherein said circular path of said enclosed liquid passage in said heat receiving chamber extends about an axis coinciding with the axis of rotation of said rotor element, and wherein said liquid guide means have a guide surface portion for guiding a flow of the heat exchanging liquid toward a radially outer region of the enclosed liquid passage when the heat exchanging liquid enters said heat receiving chamber.

9. A viscous fluid type heat generator according to claim 1, wherein said liquid inlet of said housing assembly includes an open mouth having radially inner and outer ends with respect to the axis around which said enclosed liquid passage in said heat receiving chamber extends, and wherein said predetermined position of said liquid guide means is set at an intermediate position between said radially inner and outer ends of said open mouth of said liquid inlet.

10. A viscous fluid type heat generator according to claim 2, wherein said partitioning wall assembly for defining said enclosed liquid passage in said heat receiving chamber comprises a plurality of annularly extending concentric walls by which a plurality of annular liquid passages are formed between said liquid inlet and said liquid outlet to be concentric with one another with respect to an axis coinciding with the axis of rotation of said rotor element.

11. A viscous fluid type heat generator according to claim 10, wherein said plurality of concentric annular liquid passages in said heat receiving chamber are provided with different radial widths satisfying such a condition that the radial widths of said plurality of concentric annular liquid passages are gradually increased in response to a change in an arrangement of said annular liquid passages from a radially innermost annular liquid passage to a radially outermost annular liquid passage.

12. A viscous fluid type heat generator according to claim 10, wherein said plurality of concentric annular liquid passages in said heat receiving chamber lie in a plane substantially perpendicular to said axis coinciding with the axis of rotation of said rotor element, and wherein said liquid inlet and outlet being juxtaposed with one another in said plane.

13. A viscous fluid type heat generator according to claim 12, wherein said plane in which said plurality of concentric annular liquid passages lie is a vertical plane, and wherein said liquid inlet is arranged vertically below said liquid outlet.

14. A viscous fluid type heat generator adapted for being incorporated in a vehicle heating system employing an engine cooling water of a vehicle as a heat carrying medium, comprising:

a housing assembly defining therein a vertical fluid-tight heat generating chamber in which a viscous fluid is held to frictionally generate heat by application of a shearing action thereto, and a vertical heat receiving chamber arranged adjacent to said fluid-tight heat generating chamber for permitting the engine cooling water to flow therethrough to thereby receive heat transmitting from the viscous fluid in said fluid-tight heat generating chamber, said housing assembly having a water inlet through which the engine cooling water is introduced into said heat receiving chamber and a water outlet through which the engine cooling water is discharged from said heat receiving chamber, said water inlet being fluidly isolated from said water outlet;

a substantially horizontal drive shaft supported by said housing assembly to be rotatable about a substantially horizontal axis of rotation thereof upon being driven by a vehicle engine;

a rotor element mounted to be rotationally driven by said horizontal drive shaft for rotation together within said fluid-tight heat generating chamber, said rotor element having vertical outer faces extending circularly about the axis of rotation thereof and acting as shearing application primary faces to apply the shearing action to the viscous fluid during the rotation thereof;

a partitioning wall assembly for defining an enclosed liquid passage in said vertical heat receiving chamber to have a predetermined length of a circular path extending between opposite ends of said enclosed liquid passage, one end of said enclosed liquid passage being fluidly connected to said water inlet of said housing assembly and the other end being fluidly connected to said water outlet of said housing assembly; and, a liquid guide means arranged adjacent to said water inlet for guiding a flow of the heat exchanging water to be directed toward the entirity of said enclosed liquid passage at said water inlet when the heat exchanging liquid enters said vertical heat receiving chamber through said water inlet of said housing assembly.

15. A viscous fluid type heat generator according to claim 14, wherein said water inlet is arranged to be juxtaposed with said water outlet, said water inlet being disposed vertically below said water outlet.

* * * * *

UNITED STATES PATENT AND TRADEMARK OFFICE

CERTIFICATE OF CORRECTION

PATENT NO. : 5,875,741

DATED : March 2,1999

INVENTOR(S) : Moroi, et al.

It is certified that error appears in the above-identified patent and that said Letters Patent is hereby corrected as shown below:

Claims 1 and 14, line 4 from the bottom of each claim; change "entirity" to --entirety--

Signed and Sealed this

Twenty-seventh Day of July, 1999

*Attest:*

Q. TODD DICKINSON

*Attesting Officer*

*Acting Commissioner of Patents and Trademarks*